US007073864B2

(12) United States Patent
Olsen

(10) Patent No.: US 7,073,864 B2
(45) Date of Patent: Jul. 11, 2006

(54) STACKABLE CHAIR WITH FLEXING FRAME

(75) Inventor: Ogden R. Olsen, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/461,081

(22) Filed: Jun. 13, 2003

(65) Prior Publication Data

US 2004/0251729 A1 Dec. 16, 2004

(51) Int. Cl.
*A47C 3/04* (2006.01)

(52) U.S. Cl. ..... 297/447.1; 297/447.3; 297/448.2; 297/239; 297/18

(58) Field of Classification Search ..... 297/18, 297/239, 287, 447.1, 447.2, 447.3, 447.4, 297/448.2
See application file for complete search history.

(56) References Cited

U.S. PATENT DOCUMENTS

| | | | | | |
|---|---|---|---|---|---|
| 1,856,429 | A | * | 5/1932 | Rodriguez | 297/18 |
| 1,949,282 | A | * | 2/1934 | Murray | 297/18 |
| 2,708,960 | A | * | 5/1955 | Shephard | 297/18 |
| 3,847,433 | A | * | 11/1974 | Acton et al. | 297/239 |
| 4,522,444 | A | * | 6/1985 | Pollock | 297/239 |
| 4,618,185 | A | * | 10/1986 | Kaufman | 297/285 |
| 4,938,530 | A | * | 7/1990 | Snyder et al. | 297/287 |
| 5,112,107 | A | * | 5/1992 | Doughty | 297/288 |
| D337,003 | S | | 7/1993 | Rowland | |
| D342,839 | S | | 1/1994 | Olson | |
| D367,185 | S | | 2/1996 | Olson | |
| 5,626,394 | A | * | 5/1997 | Perry | 297/448.2 |
| D397,880 | S | | 9/1998 | Saul | |
| D423,805 | S | | 5/2000 | Olson | |
| D437,704 | S | | 2/2001 | Koepke et al. | |

FOREIGN PATENT DOCUMENTS

| | | | |
|---|---|---|---|
| FR | 2623985 | * | 6/1989 |

* cited by examiner

*Primary Examiner*—Peter R. Brown
(74) *Attorney, Agent, or Firm*—Joseph H. Golant; Jones Day

(57) ABSTRACT

A stackable chair has supporting side members that comprise two bars that cross one another in non-contacting relation to form a substantially X-shaped configuration, the two bars capable of flexing movement relative to one another, so that the chair can flex in response to the weight and movement of the user.

21 Claims, 7 Drawing Sheets

STACKABLE CHAIR WITH FLEXING FRAME

CROSS REFERENCE TO RELATED APPLICATIONS

This application is related to design applications filed on the same date herewith, and having Ser. Nos. 29/183,640, 29/183,639, 29/183,638, 29/183,637, and 29/183,580.

BACKGROUND OF THE INVENTION

This invention relates to stacking chairs, and in particular to stacking chairs having flexing frames to enhance comfort for the user.

Stackable chairs are well known in the art. Such chairs are used to provide temporary seating for large numbers of persons, such as for meetings, conferences and the like. It is desirable that stacking chairs be relatively lightweight and easy to store. It is further desirable that such chairs provide optimum comfort for the user. It can be difficult to provide for comfort in a stackable chair, because such chairs are typically constructed of rigid materials fastened together in fixed relation, such that the chair affords the user little or no range of motion.

U.S. Pat. No. 70,756 discloses a chair having bracing springs between the stool and the seat, which keep the seat in a level position yet by their elasticity allow it to tip back and forward to provide a rocking motion, in which chair the portion that supports the stool is not flexible.

U.S. Pat. No. 2,675,059 discloses a rockable reclining chair having a rectangular back frame and a rectangular seat frame in crossed relation, in which rocking is provided by rotation of rigid members about two pivot points.

U.S. Pat. No. 2,679,282 discloses an infant's chair having side frame members in the form of a FIG. 8.

U.S. Pat. No. 2,708,960, discloses a foldable rocking chair having a seat frame and a back frame that cross each other.

U.S. Pat. No. 3,847,433 discloses a stacking chair in which the seat flips up to allow a person to pass within a row of such chairs.

U.S. Pat. No. 4,522,444 discloses a flexible stacking chair wherein the frame comprises side members in a "Z" configuration.

U.S. Pat. No. 4,597,604 discloses a support structure for chairs having pivoting members.

U.S. Pat. No. 4,674,795 discloses a flexible stacking chair comprising two side compression support members and center diagonal tension members.

U.S. Pat. No. 4,699,422 discloses a reclining and swingable chair.

U.S. Pat. No. 5,823,626 discloses a chair with a seat and chair back tiltably carried on a base. In one embodiment, the chair base comprises two triangular shaped side members.

U.S. Pub. No. US 2003/0090139 discloses a chair having a frame and support board that allows the chair back to be tilted backward in response to pressure.

It is thus one object of the invention to provide a chair that is stackable yet allows some range of flexibility to be more comfortable for a user.

It is yet another object of the invention to provide such a flexible stacking chair that is of relatively lightweight construction.

It is yet another object of the invention to provide such a flexible stacking chair that is relatively simple to manufacture.

SUMMARY OF THE INVENTION

In accordance with the invention, a flexible stacking chair of the instant invention comprises a supporting frame having two side members, each side member having two bars that cross one another in non-contacting relation to form an X-shaped configuration, one of said bars having a degree of flexing motion relative to the other of said bars, such that the chair affords flexing comfort to the user. In a preferred embodiment, the chair further comprises at least one motion limiting means to limit the flexing of the two crossing bars with respect to one another. The chair comprises a back rest member and a seat member, which can be separate parts or integrally formed in a shell. The back and seat members include means for receiving portions of the supporting frame. The supporting frame, seat member, and back rest member are each configured so that the chair is stackable with a plurality of like chairs.

DETAILED DESCRIPTION OF THE PREFERRED EMBODIMENTS

Figure 1:
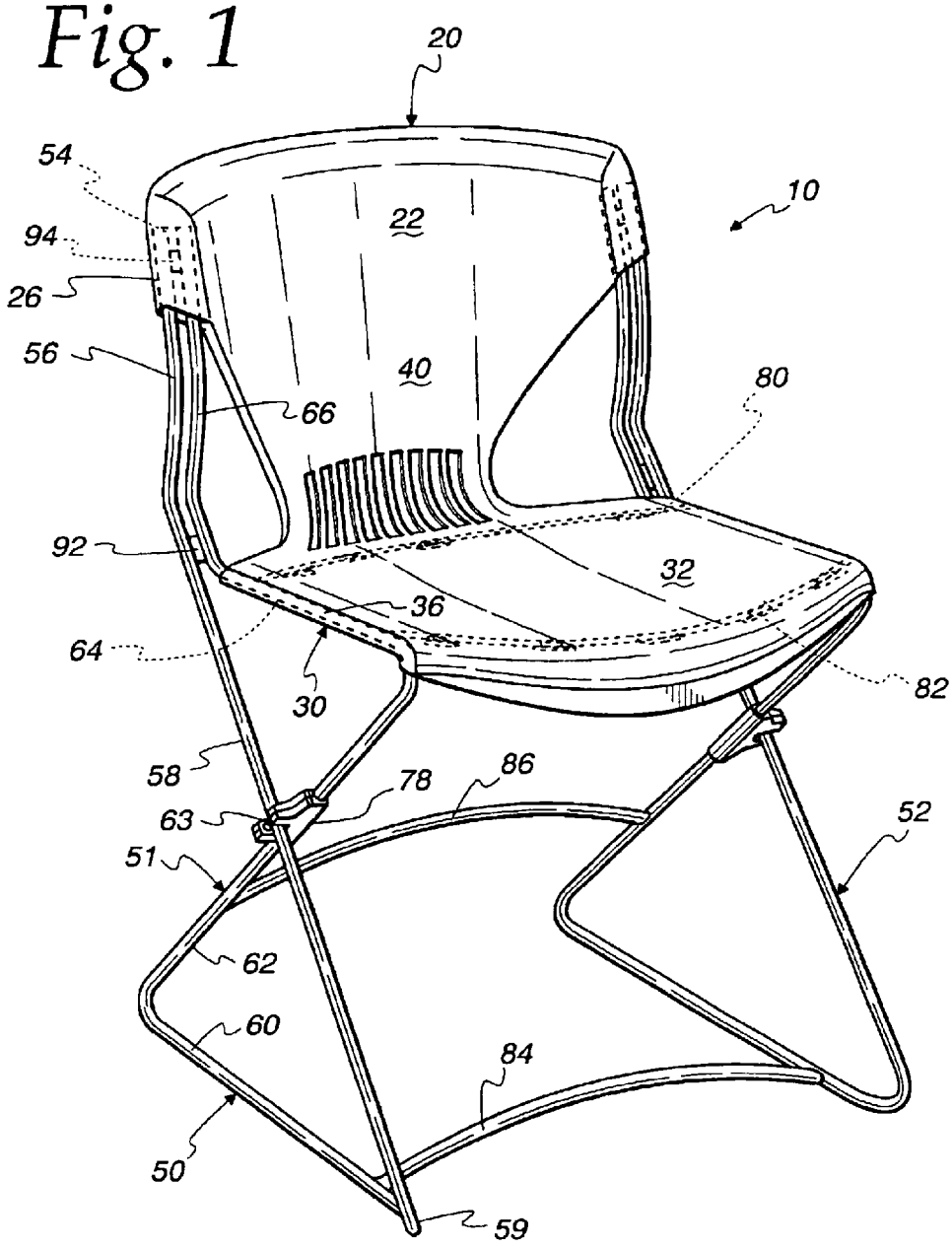
FIG. 1 is a perspective view of a first embodiment of a chair of the instant invention.
Figure 2:
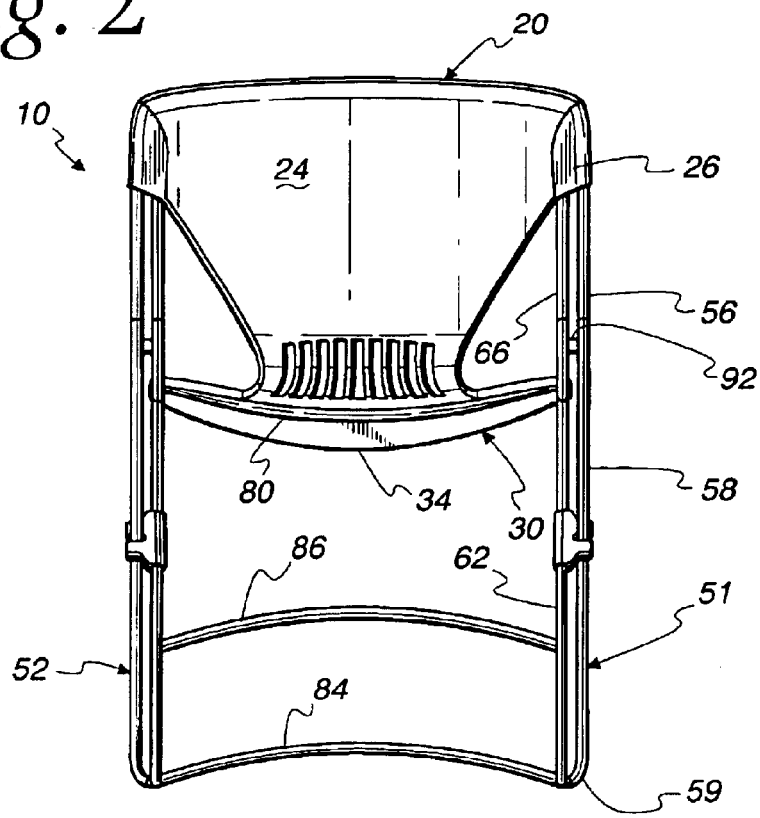
FIG. 2 is a rear elevation view of the chair of FIG. 1.

Turning to FIGS. 1–4, there is illustrated a first embodiment of a chair 10 of the instant invention comprising a frame 50, a back rest member 20, and a seat member 30. In the illustrated embodiment, back rest member 20 and seat member 30 are integrally formed in a unitary shell member 40. Back rest member 20 comprises a front surface 22 and a rear surface 24. Seat member 30 comprises an upper surface 32 and a lower surface 34.

Frame 50 is made of a material that provides strength, support, and an acceptable range of flexibility. A material that is too stiff will not provide enough flexing action to optimize comfort for the user, while a material that is too flexible will not provide adequate support for some users. Steel wire of 7/16" diameter is a preferred material known to provide sufficient support and flexibility; those skilled in the art may recognize other materials that will also be suitable.

Frame 50 comprises first and second side members 51 and 52 that are substantially mirror images of each other, and which are disposed at the opposite lateral edges of unitary shell member 40. Only side member 51 will be described in detail, it being understood that side member 52 will have identical components arranged in an identical but mirror image configuration. First side member 51 can be advantageously in the form of a continuous steel wire. First side member 51 comprises a first upper end 54, from which downwardly extends first back rest supporting member 56. Integrally connected to back rest supporting member 56 is bar 58 which extends generally from the rear edge of seat member 30 diagonally downwardly and forwardly to bend 59, and then rearwardly into base connecting member 60. By virtue of bend 59, bar 58 and base connecting member 60 lie in substantially parallel vertical planes. Base connecting member 60 rests on the floor, and serves to integrally connect bend 59 with the lower most portion of bar 62. Bar 62 rises diagonally forwardly from the rear end of base connecting member 60 to the forward upper edge of seat member 30. Bar 62 lies in substantially the same vertical pane as base connecting member 60. Thus, bar 58 and bar 62 cross one another in non-connecting relation at cross point 63 to form a substantially X-shaped configuration. The upper forward end of bar 62 is integrally connected to seat supporting member 64, which extends rearwardly along the lateral edge of lower surface 34 of seat member 30. Seat supporting member 64 is integrally connected at its rearward end to second back rest supporting member 66, which is substantially parallel to first back rest supporting member 56. It will be appreciated that in some embodiments either back rest supporting member 56 or back rest supporting member 66 can be obviated, i.e., only one back rest supporting member may be necessary.

Back rest member 20 comprises means 26 for securing the back rest supporting members 56, 66 thereto. In the illustrated embodiment, securing means 26 is in the form of a sleeve or pocket molded into the rear surface 24 of back rest member 20 at the lateral edges thereof, which sleeve or pocket receives the upper ends of members 56, 66 in sliding frictional engagement. Those skilled in the art will appreciate that means for securing the back rest supporting members 56, 66 to back rest member 20 can be in the form of conventional fastening means such as bolts, rivets, and the like. Further, while it is preferred that back rest supporting members 56, 66 be secured to back rest member 20 along the lateral edges of rear surface 24, it is within the scope of this invention to secure the back rest supporting members at other locations on either surface of the back rest member 20.

Similarly, seat member 30 comprises means 36 for securing the seat supporting member 64 thereto. In the illustrated embodiment, securing means 36 is in the form of a sleeve or pocket molded into the lower surface 34 of seat member 30 at the lateral edges thereof, which receives seat supporting member 64 in sliding frictional engagement. Those skilled in the art will appreciate that means for securing the seat supporting member 64 to seat member 30 alternatively can be in the form of conventional fastening means such as bolts, rivets, and the like. Further, while it is preferred that seat supporting member 64 be secured to seat member 30 along the lateral edges of lower surface 34, it is within the scope of this invention to secure the seat supporting member 64 at other locations on either surface of the seat member 30.

Figure 5:
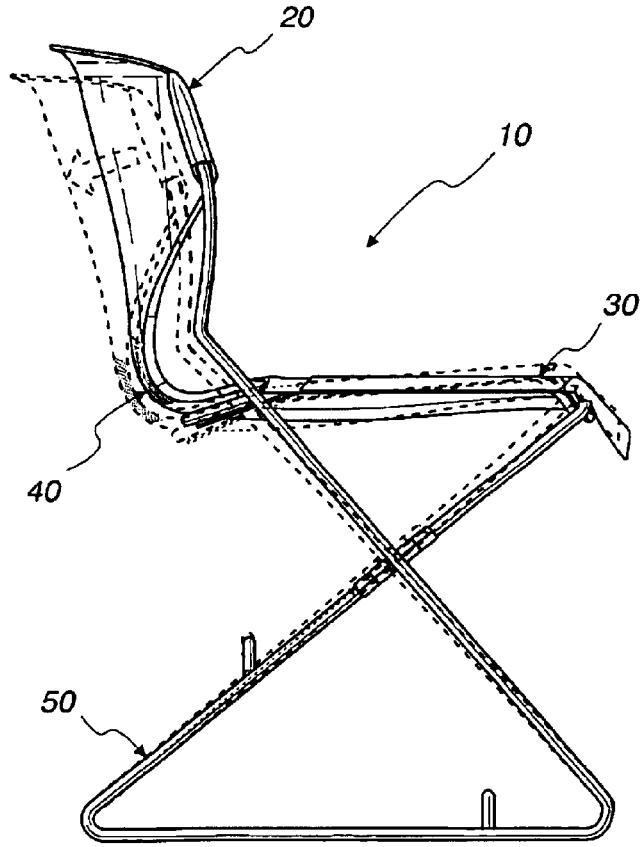
FIG. 5 is a side elevation view of the chair of FIG. 1 and illustrates the flexing motion of the chair.
Figure 7:
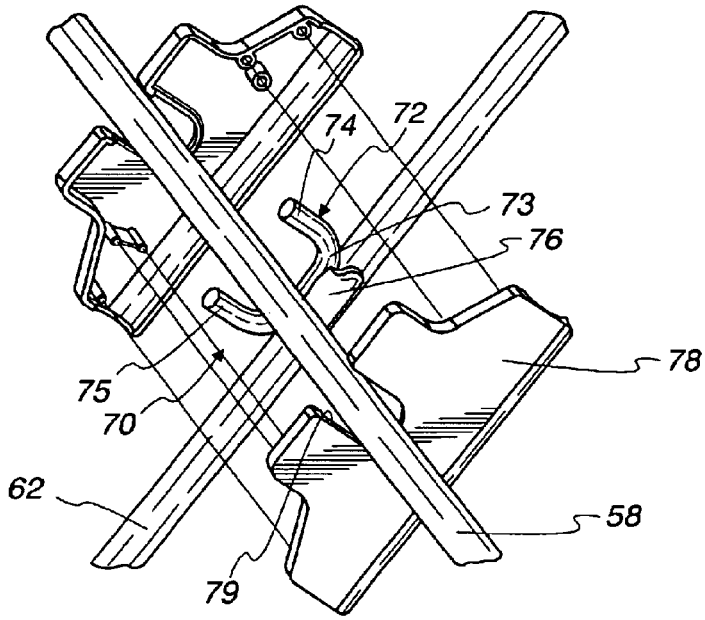
FIG. 7 is an exploded perspective view and illustrates the motion limiting means of the chair of FIG. 1.
Figure 8A:
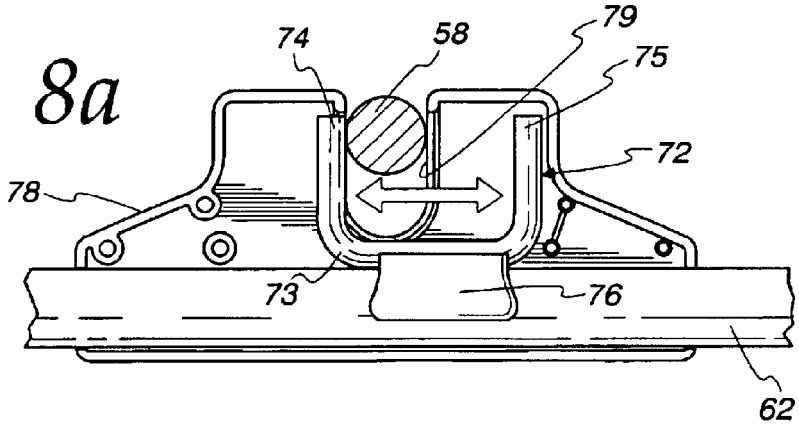
FIGS. 8*a* and 8*b* are cross-sectional views of the motion limiting means showing the relative movement of the cross-bar.
Figure 8B:
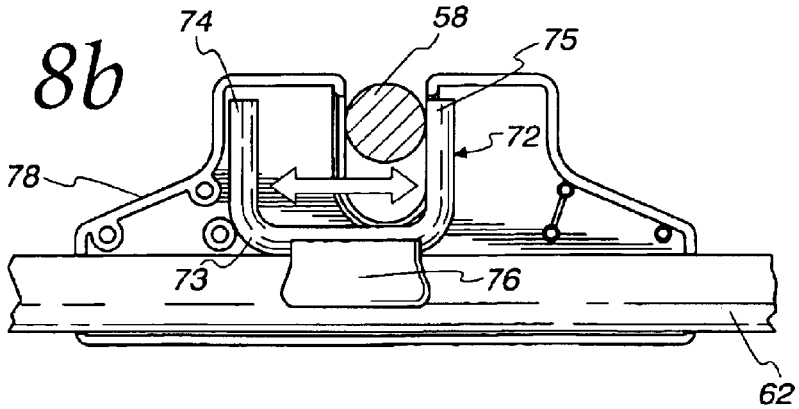

In use, the weight of a user seated in chair 10 will exert a downward force on seat member 30 that will be transmitted through diagonal bars 58, 62 of side members 51, 52. Because side members 51, 52 are formed of a material having some limited flexibility, such as the steel wire described above, diagonal bars 58, 62 will flex reciprocably downwardly in response to the weight and motions of the user. In this respect, it is significant that bars 58, 62 cross one another in non-connecting relation at cross point 63. The lack of a fixed connection allows a range of reciprocable motion of the two bars with respect to one another. This motion is illustrated in FIG. 5. It is desirable, however, to limit this range of motion. Thus, each side member 51, 52 preferably is provided with a means 70 for limiting the flexing motion. As illustrated in FIGS. 7, 8*a* and 8*b*, motion limiting means 70 can comprise a U-shaped member 72 having a base 73 and extending arms 74, 75, the opening between the arms 74, 75 being substantially wider than the diameter of cross bar 58. Base 73 of U-shaped member 72 is fixedly mounted to cross bar 62 at about cross point 63, such that cross bar 58 is retained between the arms 74, 75 of the U-shaped member 70 such as by weld 76. It will be appreciated that other means known to those skilled in the art can be used to fixedly mount motion limiting means 70, such as a lug or rivet. The range of motion of bar 58 relative to bar 62 will be limited by the distance separating the inner surfaces of extending arms 74, 75 of U-shaped member 72. The spacing between the inner surface of extending arms 74, 75 can be pre-selected to obtain the range of reciprocable motion desired for the bars with respect to one another. To reduce the danger of fingers being caught between bar 58 and U-shaped member 72, a cover 78 can be snap-fitted over motion limiting means 70. Cover 78 includes a U-shaped pocket 79 that surrounds U-shaped member 72. The cover 78 moves with bar 62 along cross bar 58. Pocket 79 is sufficiently wide such that the inner surfaces of pocket 79 do not contact arms 74, 75 of U-shaped member 72 at either extreme of its range of motion, as shown in FIGS. 8*a* and 8*b*.

Figure 3:
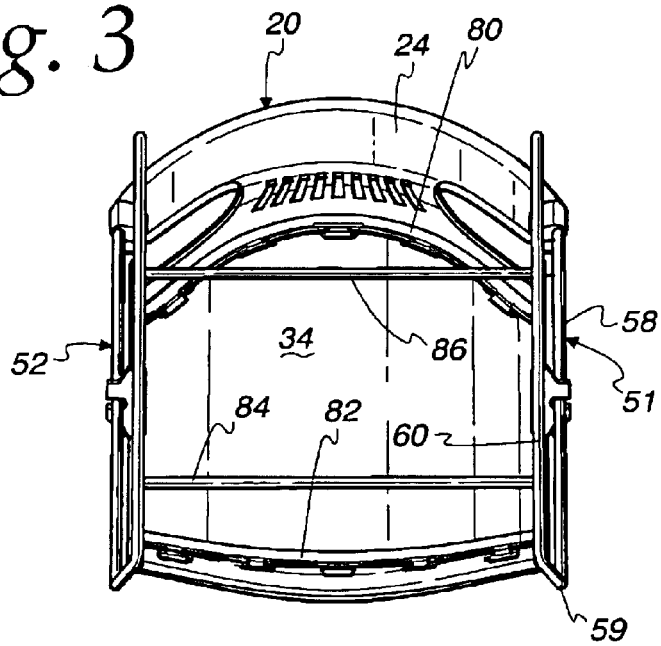
FIG. 3 is a bottom plan view of the chair of FIG. 1.
Figure 4:
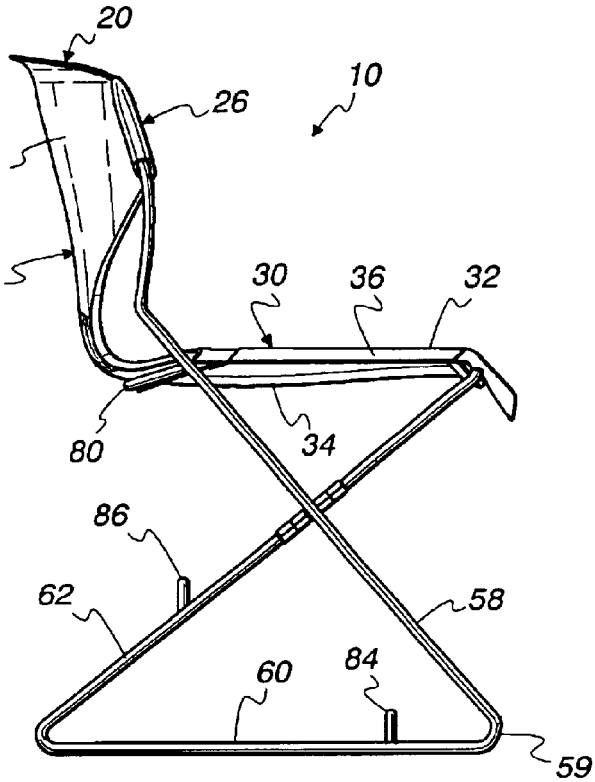
FIG. 4 is a side elevation view of the chair of FIG. 1.

In a preferred embodiment, frame 50 can be provided with one or more additional support members to provide greater stability to the chair 10. As shown in FIG. 3 and in dotted lines in FIG. 1, one or more transverse supporting members 80, 82 can extend beneath seat member 30 between seat supporting members 64 of side members 51, 52. The lower portion of frame 50 can be provided with base member bracing means 84 that extends between base connecting members 60 of side members 51, 52; base member bracing means 84 is preferably of arcuate configuration. Similarly, side member bracing means 86 extends between bars 62 of each of side members 51, 52; side member bracing means 86 also is preferably of arcuate configuration. While in the illustrated embodiment base member bracing means 84 is toward the front end of the base members 60 and side member bracing means spans bars 62 toward the rear of the chair, the chair also may be constructed with base member 84 toward the rear ends of base members 60 and side member bracing means 86 extending between bars 58 of side members 51, 52 toward the front of the chair. It also may be desirable to support each side member 51, 52 with spacer plates. For example, spacer plates 92 can be welded between first and second back rest supporting members 56,66 at the lower ends thereof, and spacer plates 94 can be welded between first and second back rest supporting members 56, 66 at the upper ends thereof, which spacer plate 94 may be received within the sleeve or pocket of the means 26 for securing the back rest supporting members to the back rest.

Figure 6:
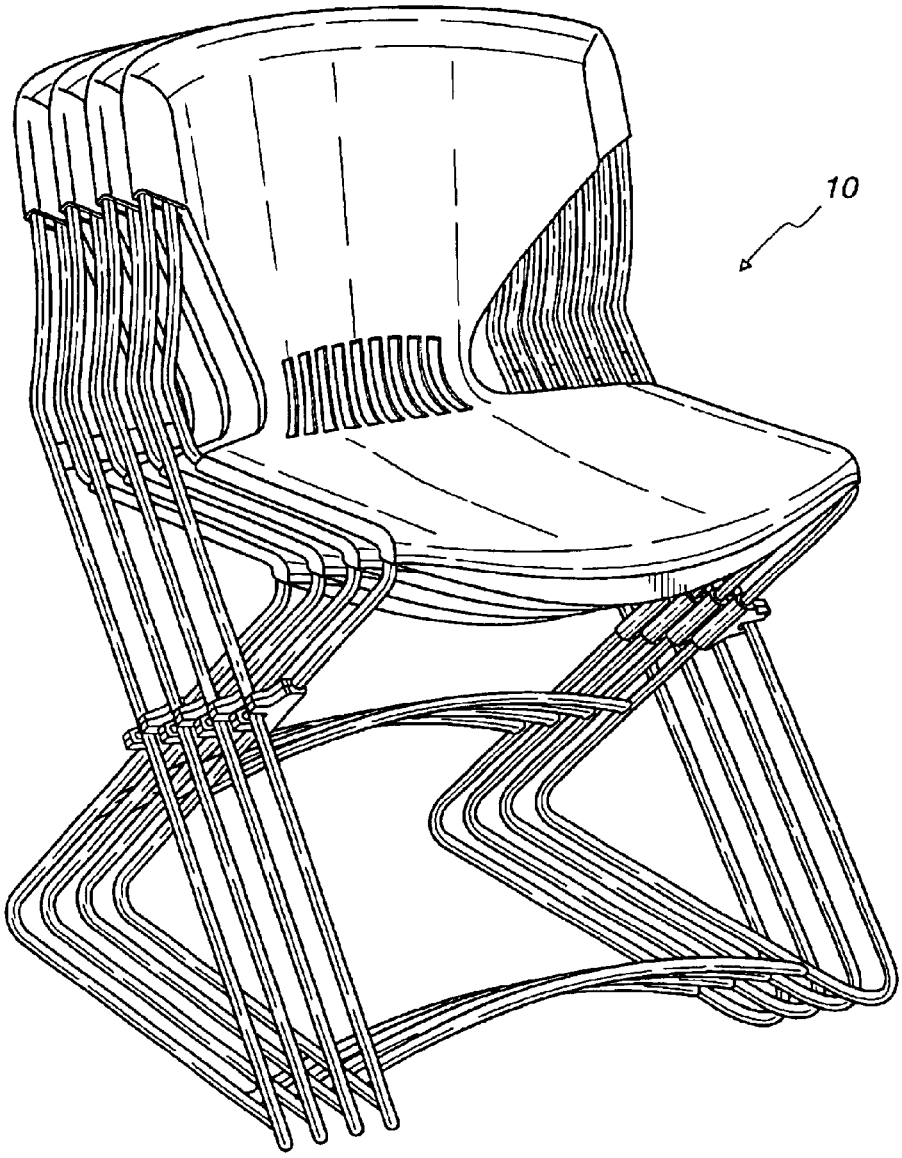
FIG. 6 is a perspective view of a plurality of chairs of FIG. 1 in stacked relation.

Advantageously, a plurality of the chairs of the embodiment shown in FIG. 1 are stackable, as illustrated in FIG. 6. To stack the chairs, one chair is placed in front of another, the rear ends of the base connecting members 60 of the front chair are placed between the bends 59 of the rear chair, and the front chair is slid backward onto the rear chair.

Figure 9:
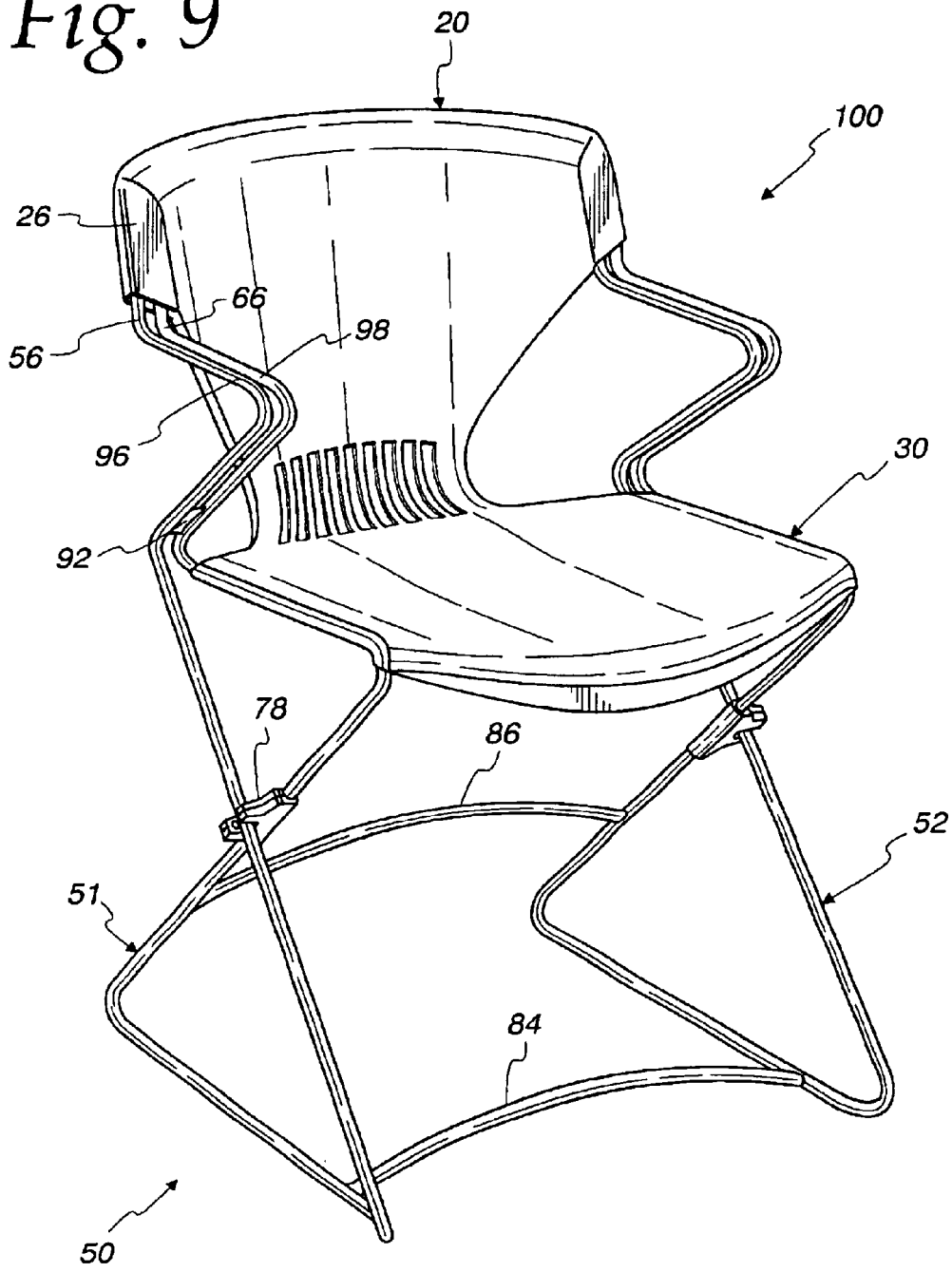
FIG. 9 is a perspective view of a second embodiment of a chair of the instant invention.
Figure 10:
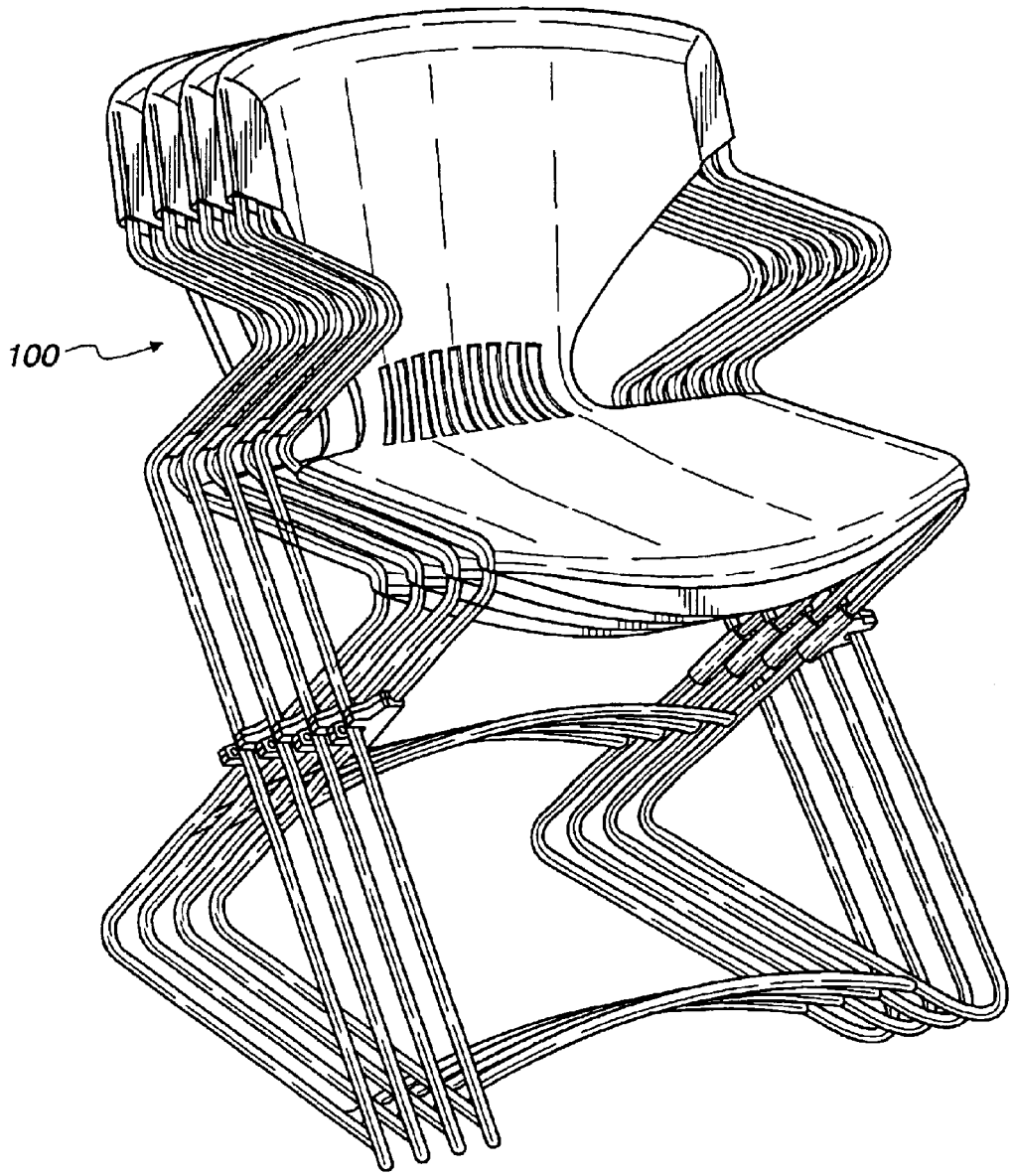
FIG. 10 is a perspective view of a plurality of the chairs shown in FIG. 9 in stacked relation.

Referring to FIG. 9, there is illustrated an alternative embodiment chair 100 of the chair of FIG. 1, in which all parts identified in FIGS. 1–8*b* are identically present, and which embodiment further includes arm rest support members 96, 98 formed from back rest support members 56, 66, of each side member 51, 52. The arm rest support members 96, 98 can function themselves as arm rests, or a molded arm rest can be affixed over the arm rest support members 96, 98. The embodiment of FIG. 9 is also stackable, as illustrated in FIG. 10.

While the present invention has been described with reference to the presently preferred embodiments, it will be understood by those skilled in the art that variations may be made thereto without departing from the spirit of the invention which is limited in scope only by the appended claims

What is claimed is:

1. A flexible stacking chair comprising:

a seat having a front portion, a rear portion and lateral side portions;

a back having an upper portion, a lower portion and lateral side portions;

a frame for supporting said seat and said back, said frame having a first side formed of a single steel wire having a first rearwardly located, upper vertical portion integral with a forward extending horizontal portion which is integral with a first leg portion extending from said horizontal portion downwardly and rearwardly, said first leg portion integral with a rear bent portion which is integral with a horizontal runner portion extending forwardly from said rear bent portion, said runner portion being integral with a front curved and bent portion which is integral with a second leg portion extending upwardly and rearwardly from said front curved and bent portion, said second leg portion being integral with a second rearwardly located, upper vertical portion located alongside and generally parallel to said first upper vertical portion, said first and said second legs crossing and not touching, and a second side formed of another single steel wire having a first rearwardly located, upper vertical portion integral with a forward extending horizontal portion which is integral with a first leg extending from said horizontal portion downwardly and rearwardly, said first leg integral with a rear bent portion which is integral with a horizontal runner portion extending forwardly from said rear bent portion, said runner portion being integral with a front curved and bent portion which is integral with a second leg extending upwardly and rearwardly from said front curved and bent portion, said second leg being integral with a second rearwardly located, upper vertical portion located along side and generally parallel to said first upper rearward vertical portion, said first and said second legs crossing and not touching;

a first restraint fixed to said first leg of said first side of said frame for limiting rotation of said second leg of said first side of said frame downwardly and upwardly about said front curved and bent portion of said first side of said frame; and a second restraint fixed to said first leg of said second side of said frame for limiting rotation of said second leg of said second side of said frame upwardly and downwardly about said front curved and bent portion of said second side of said frame.

2. The chair of claim 1 wherein:

said first and said second restraints each include upper and lower arms, one of said arms to each side of the respective second leg.

3. The chair of claim 1 including:

a slidable cover mounted over each of said restraints, said cover being slidable along a respective first leg in response to movement of a respective second leg.

4. The chair of claim 1 wherein:

said front curved and bent portions diverge outwardly.

5. The chair of claim 1 including:

pockets in said back.

6. The chair of claim 1 including:

lateral pockets in said seat.

7. The chair of claim 1 including:

braces under said seat.

8. The chair of claim 1 including:

a brace between said first leg of said first side and said first leg of said second side of said frame.

9. The chair of claim 8 wherein:

said brace is arcuate.

10. The chair of claim 1 including:

a brace between said runner portions of said frame.

11. The chair of claim 10 wherein:

said brace is arcuate.

12. The chair of claim 1 wherein:

said seat and said back are integral.

13. The chair of claim 1 including:

spacers between said first and said second vertical portions of said frame.

14. The chair of claim 1 wherein:

said first and said second restraints each include upper and lower arms, one of said arms to each side of the respective second leg; and a slidable cover mounted over each of said restraints, said cover being slidable along a respective first leg in response to movement of a respective second leg.

15. The chair of claim 14 wherein:

said front curved and bent portions diverge outwardly.

16. The chair of claim 15 including:

pockets in said back;

lateral pockets in said seat;

a brace between said first legs of said first side and said second side of said frame; and a brace between said runner portions of said frame.

17. The chair of claim 16 wherein:

said seat is supported by said forward extending horizontal portions of said steel wires of said first side and said second side of said frame; and said back is supported by said first and said second rearwardly located upper vertical portions of said first side and said second side of said frame.

18. The chair of claim 1 including:

pockets in said lateral side portions of said back; and pockets in said lateral side portions of said seat.

19. The chair of claim 18 wherein:

said seat and said back are integral.

20. The chair of claim 1 including:

a brace between said first legs of said first side and said second side of said frame; and a brace between said runner portions of said first side and said second side of said frame.

21. The chair of claim 20 wherein:

said brace between said first legs is arcuate; and said brace between runner portions is arcuate.

* * * * *